United States Patent [19]

Mansell

[11] 3,986,379

[45] Oct. 19, 1976

[54] DIE PAD ASSEMBLY

[75] Inventor: Ivor Mansell, Oakville, Canada

[73] Assignee: Mansell Engineering Limited, Oakville, Canada

[22] Filed: Jan. 28, 1976

[21] Appl. No.: 653,172

[30] Foreign Application Priority Data

Feb. 4, 1975 Canada ..... 219393

[52] U.S. Cl. ..... 72/57; 72/461; 72/465; 72/473; 72/DIG. 14

[51] Int. Cl.[2] ..... B21D 5/01

[58] Field of Search ..... 72/57, 461, 465, 473, 72/477, DIG. 14; 267/130

[56] References Cited

UNITED STATES PATENTS

| | | | |
|---|---|---|---|
| 2,841,083 | 7/1958 | Kirkpatrick et al. | 72/57 |
| 3,382,690 | 5/1968 | Achler et al. | 72/57 |

FOREIGN PATENTS OR APPLICATIONS

| | | | |
|---|---|---|---|
| 1,062,341 | 3/1967 | United Kingdom | 72/465 |

*Primary Examiner*—Lowell A. Larson
*Attorney, Agent, or Firm*—Rogers, Bereskin & Parr

[57] ABSTRACT

A die pad assembly is described including a pad holder of a relatively hard elastomeric material and a pad of a softer elastomeric material. The holder defines a recess extending longitudinally of the holder and end walls closing the ends of said recess. The recess is of a cross-sectional shape defining opposed downwardly convergent wall portions and conforming generally to the shape into which articles are to be formed using the assembly. The pad is snugly received in said recess in the holder between said end walls. The pad has an upper surface to support an article to be formed and a lower surface at least parts of which are in surface contact with the convergent wall portions of the recess in the holder. In use, an article to be formed is placed on the upper surface of the pad and is engaged by the male die. Movement of the die against the article causes the pad to be compressed between the leading extremity of the die and the wall of the recess in the holder to cause the article to bend about the die. The elastomeric material from which the holder is made is capable of resilient deformation in the event that the die contacts the holder in use.

11 Claims, 5 Drawing Figures

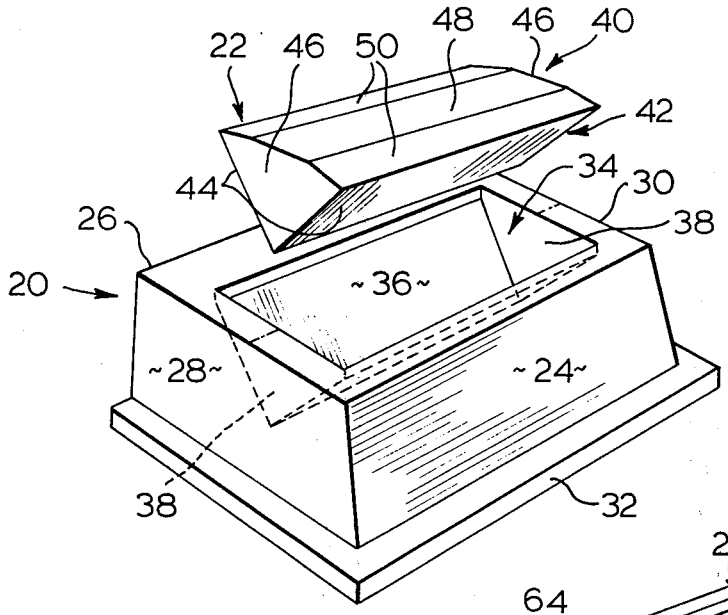
FIG. 1
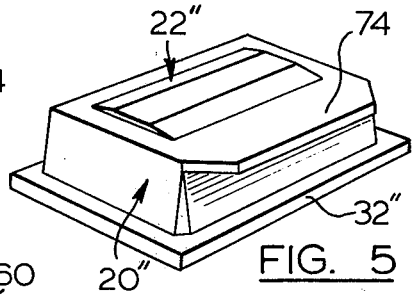
FIG. 5
FIG. 2
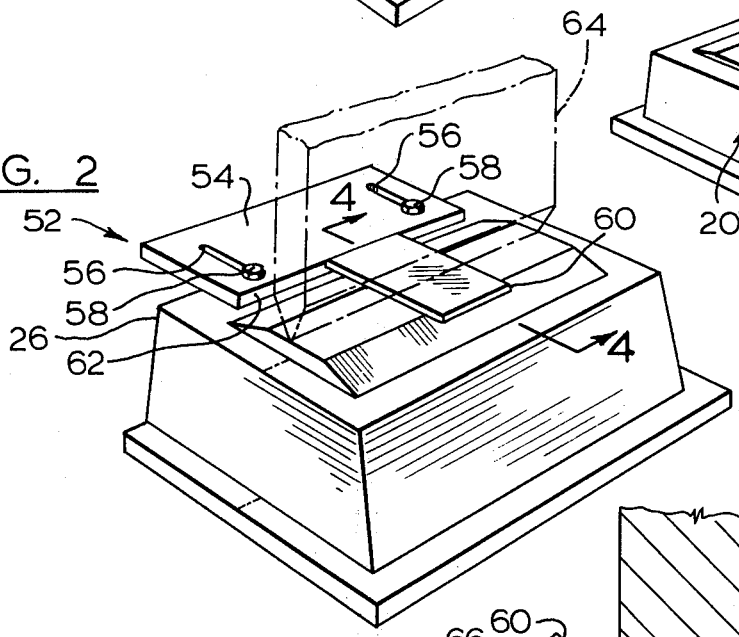
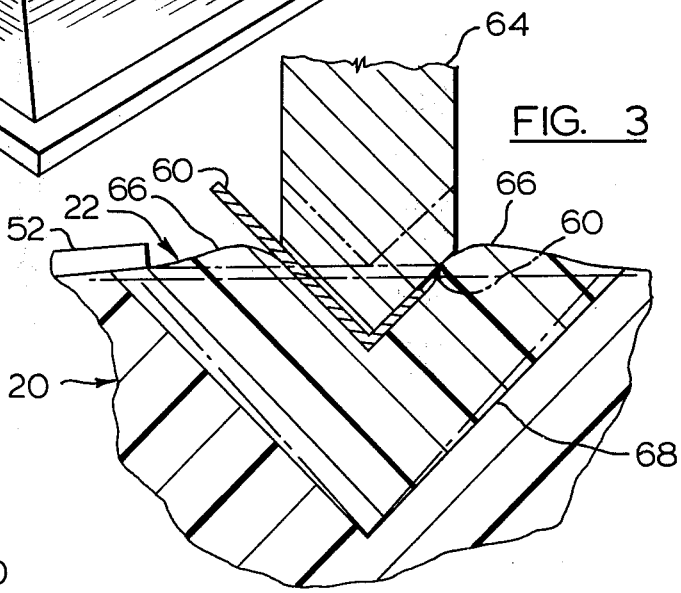
FIG. 3
FIG. 4
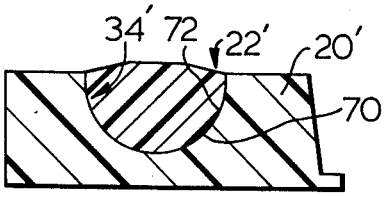

DIE PAD ASSEMBLY

This invention relates to a die pad assembly co-operable with a male die for use in press forming sheet material.

In the forming art, it is known to provide a die pad assembly including a pad of an elastomeric material and a holder or retainer for the pad. A male die is applied to an article supported on the pad and the die forces the article into the pad, causing the pad to deform as the article conforms to the shape of the die. A die pad assembly including an elastomeric die pad is disclosed in the present inventor's U.S. Pat. No. 3,760,622. Sometimes a conventional female die serves as a holder for an elastomeric die pad. In other situations, the pad is mounted in a special holder or retainer. U.S. Pat. No. 3,276,239 — Achler et al., discloses a retainer for a die pad of urethane rubber. The retainer takes the form of an elongate aluminum extrusion formed with a longitudinally extending open-ended recess which receives the pad.

Prior art die pad assemblies include relatively long pads and are intended primarily for use in forming relatively long bends in sheet metal articles. It would be desirable to use a short die pad of appropriate resilience when forming small articles in order to ensure accurate control of the forming operation. However, if a short length of pad is used in a conventional holder such as that disclosed in the Achler U.S. Patent, or in a conventional female die, undue surface stresses are set up in the pad as the male die acts on the article to be formed. These stresses may cause the pad to break up.

An object of the present invention is to provide an improved die pad assembly for use in press forming relatively small articles of sheet material.

According to one aspect of the invention the assembly includes a pad holder of a relatively hard elastomeric material and a pad of a softer elastomeric material. The holder defines a recess extending longitudinally of the holder and end walls closing the ends of said recess. The recess is of a cross-sectional shape defining opposed downwardly convergent wall portions and conforming generally to the shape into which articles are to be formed using the assembly. The pad is snugly received in said recess in the holder between said end walls. The pad has an upper surface to support an article to be formed and a lower surface at least parts of which are in surface contact with the convergent wall portions of the recess in the holder. In use, an article to be formed is placed on the upper surface of the pad and is engaged by the male die. Movement of the die against the article causes the pad to be compressed between the leading extremity of the die and the wall of the recess in the holder to cause the article to bend about the die. The elastomeric material from which the holder is made is capable of resilient deformation in the event that the die contacts the holder in use.

According to other aspects, the invention also provides a pad holder and a plurality of die pads of respectively different hardnesses for selective use in association with the holder, and a die pad holder per se.

Preferred embodiments of the invention will now be described with reference to the accompanying drawings, in which:

FIG. 1 is an exploded perspective view from above of a die pad and holder according to one embodiment of the invention;

FIG. 2 is a perspective view from above showing the pad and holder of FIG. 1 assembled, a male die being indicated in ghost outline;

FIG. 3 is an enlarged cross-sectional view corresponding to FIG. 1 showing how the die pad is deformed during a forming operation;

FIG. 4 is a cross-sectional view through a die pad assembly according to an alternative embodiment of the invention; and FIG. 5 is a perspective view from above of a die pad assembly according to a further alternative embodiment.

Reference will first be made to FIG. 1, which shows a die pad assembly including a die pad holder generally indicated at 20 and a die pad 22. The holder 20 is moulded in a relatively hard elastomeric material and is of generally square shape in plan, including a front wall 24, a rear wall 26 and end walls 28 and 30. A flange 32 is formed around the lower margins of the front walls 24 and the end walls 28 so that the holder can be clamped onto the bed of a press in use. The rear wall 26 is plain and provides a reference face on the holder.

The holder defines a longitudinally extending recess 34 having a pair of mutually inclined side walls 36 disposed symmetrically about a vertical plane extending longitudinally of the holder. The end walls 28 of the holder close the ends of the recess 34. The inner surfaces 38 of the end walls 28 are vertical.

The die pad 22 is made of a somewhat softer elastomeric material than the holder 20 and is dimensioned to snugly fit into the recess 34 between the end walls 28 of the holder. Pad 22 has an upper surface 40 for supporting an article to be formed and a lower surface 42 including a pair of side walls 44 and a pair of end walls 46. The side walls 44 are disposed angularly with respect to one another at substantially the same angle as the side walls 36 of the recess 34. The upper surface 40 of the pad 22 includes a raised central strip 48 and inclined side strips 50.

A flexible backstop generally designated 52 is adjustably mounted on the upper surface of the holder 20 at the top of the rear wall 26. The backstop 52 is formed by a rectangular plate 54 of a flexible elastomeric material formed with a pair of parallel grooves 56 each receiving an adjusting screw 58 threaded into the holder 20. In FIG. 2, an article in the form of a blank is indicated at 60 and is positioned in contact with the leading edge 62 of the plate 54. Edge 62 provides a reference face for use in positioning the blank 60 with respect to the path of a male die indicated in ghost outline at 64. It will be appreciated that, by releasing the screws 56, plate 54 can be adjusted to vary the position of the blank 60. If required, the screws 58 can be completely removed and the plate 54 turned around so that it will project further over the upper surface of the pad 22.

Assume that the holder 20 is clamped to the bed of a press and that the blank 60 is to be formed into an angular configuration. The blank is positioned on the die pad 22 with its intended fold line directly in the path of the male die 64. The die descends and contacts the blank 60, depressing it into the die pad 22. Referring now to FIG. 3, the male die 64, the blank, and the parts of the pad assembly are shown in ghost outline at the beginning of the forming operation and in full outline at the conclusion of the operation. As the tip of the die 64 contacts the blank 60, compression of the pad 22 results locally causing a strain. Subsequently, adjacent parts of the die 64 contact the blank and also cause a strain in the pad. By virtue of the generally V-shaped configuration of the side walls 36 of the recess 34 in the holder, the strain across the pad as the male die descends is substantially constant producing a distributed reactive load which causes the blank 60 to in effect wrap around the male die. As this happens, the elastomeric material of the pad 22 "flows" to opposite sides of the die, producing bulges in the upper surface of the pad as indicated at 66. By virtue of the resilient nature of the material from which it is made, the backstop 52 is deflected upwardly at its inner end by this bulging of the die pad.

The end walls 28 of the pad holder constrain the pad and prevent undue strains being set up in its surface. By virtue of the characteristics of the elastomeric material from which the holder is made, its walls tend to flex outwardly to some extent as indicated at 68, absorbing shock loads on the press. A further advantage is that the die pad assembly can be used with relatively long male dies. In the example being described, the male die 64 is of a length only slightly less than the length of the recess 34 of the die pad holder 20. Accordingly, if the die contacts the end walls 28 of the holder (FIG. 4), the elastomeric material from which the holder is made allows the walls to deflect under the action of the die and subsequently return to their original shape, avoiding damage to the die or to the holder. Further, an article being formed will not be damaged if it should accidentally come into contact with the die pad holder during the forming operation. This is particularly important where prefinished parts are being formed.

FIG. 4 shows a modified die assembly which may be used for particular forming operations such as forming U-shaped bends in articles. Primed reference numerals have been used in FIG. 4 to indicate parts which correspond with parts of the previous figures. The holder 20' is of the same external shape as the holder 20 of FIG. 1. Internally, however, the recess 34' of holder 24' has a curved inner surface 70 and is of U-shape in cross-section. The die pad 22' has a lower surface 72 which corresponds in shape with the shape of the surface 70 of the recess 34'. It is believed that this shape of pad and recess may be preferred when forming U-shaped bends and the like since the strain across the pad produced by the action of the male die will tend to be substantially constant producing a distributed reactive load.

Finally, FIG. 5 shows a further alternative embodiment of the invention. Double primed reference numerals have been used in this view to denote parts which correspond to parts of FIGS. 1 to 3.

The holder 20'' in this embodiment differs from that shown in the previous embodiment, primarily in that it is provided with an extended flange 74 for the purpose of attaching a backstop and in that its lower flange 32'' extends right around the holder. The recess in the holder is of V-shape in cross-section and is similar to that shown in the first embodiment. Similarly, the pad 22'' of this embodiment is similar to the pad 22 of FIG. 1.

It will be appreciated that the die pad assembly according to the invention can be used to form small metal blanks using a wide variety of different male dies. The assembly eliminates the need for a special matched lower die and can be used repeatedly with different male dies. Further, metal blanks to be formed can be accurately positioned on the die without the need for special holding devices and without requiring the operator to manually hold the article, with the attendant risk of injury.

In each of the embodiments previously described the die pad holder, backstop and pad are made of a castable solid urethane material. The holder 20 has an elastomer hardness in the range 50 to 70 measured on the Durometer D scale. The backstop 52 has a hardness of about 90 to 95 on the Durometer A scale and the pad has a hardness in the range 60 to 95 on the Durometer A scale. Normally a range of pads of different hardness within this range will be made available so that a pad can be selected appropriate to a particular forming operation. For example, it is envisaged that three pads of different hardness will be sold with each holder. These pads will have the following hardnesses measured on the Durometer A scale: 60–75; 75–85; 85–95;

In the above embodiments, the pad holder, backstop and pad(s) are made of ADIPRENE (Trade Mark) manufactured by DuPont of Canada Ltd. Other manufacturers' equivalents of ADIPRENE may of course be used. CYANAPRENE (Trade Mark) is an example of such an equivalent.

The grades of ADIPRENE used for the various parts of the die pad assembly are as follows:

pad holder — L315
backstop — L167
pad — L100 or L167

The particular grades used may vary. For example, where a particularly soft pad is required ADIPRENE L420 may be used.

It should finally be noted that the preceding description applies to specific embodiments of the invention and that many modifications are possible within its broad scope. For example, although specific types of elastomeric material have been mentioned above, it is to be understood that other materials may be used. Further, the holder and die pad may have shapes other than those shown in the drawings. In particular, the external shape of the die pad holder may vary. The shape of the internal recess in the holder preferably conforms generally to the shape into which articles are to be formed using the die pad assembly. The shape of the lower surface of the die pad will normally conform generally to the shape of the recess in the holder. In the case of a die pad having a V-shaped lower surface (as for example in FIG. 1), the bottom apex of the pad need not extend right to the the bottom of the recess in the holder; in other words, the bottom of the pad may be truncated.

What I claim is:

1. A die pad assembly co-operable with a male die for press forming relatively small articles of sheet material, the assembly comprising:

a pad holder of a relatively hard elastomeric material, the holder defining a recess extending longitudinally of the holder and end walls closing the ends of said recess, the recess being of a cross-sectional shape to define opposed downwardly convergent wall portions and conforming generally to the shape into which articles are to be formed using the assembly; and, a pad of an elastomeric material softer than the said relatively hard elastomeric material of the holder, the pad being snugly received in said recess in the holder between said end walls and having an upper surface to support an article to be formed, and a lower surface at least parts of which are in surface contact with said convergent wall portions of the said recess in the holder, whereby, in use, an article to be formed is placed on the upper surface of the pad and is engaged by the male die, movement of the die against the article causing the pad to be compressed between the leading extremity of the die and the wall of the recess in the holder to cause the article to bend about the die, the said elastomeric material of the holder being capable of resilient deformation in the event that the die contacts the holder in use.

2. A die pad assembly as claimed in claim 1, wherein the pad holder is formed around its lower margin with a laterally projecting flange by means of which the holder can be clamped to the bed of a press in use.

3. An assembly as claimed in claim 2, wherein the pad holder has a front wall and a rear wall in addition to said end walls, and wherein the said flange extends along the lower margins of said end walls and said front wall, said rear wall being plain and defining a reference face on the holder.

4. An assembly as claimed in claim 1, further comprising a backstop secured to the pad holder, the backstop having a reference face and being adjustable to vary the position of said reference face with respect to said upper surface of the die pad so that an article to be formed can be placed on said surface in contact with said reference face in the appropriate orientation with respect to the path of the male die in use.

5. An assembly as claimed in claim 4, wherein said backstop is in the form of a pad of an elastomeric material capable of flexing during a forming operation.

6. An assembly as claimed in claim 1, wherein the said recess in the pad holder includes a pair of mutually inclined side walls disposed symmetrically about a longitudinally extending plane containing the path of travel of the male die, and wherein the lower surface of the pad includes a pair of sides disposed angularly with respect to one another, the angle between these sides being substantially equal to the angle between said side walls, whereby the pad is received in the holder with respective said sides in contact with corresponding said side walls.

7. An assembly as claimed in claim 1, wherein the said recess in the pad holder is of U-shape in cross-section, and wherein the said lower surface of the pad is of complementary shape in cross-section.

8. An assembly as claimed in claim 1, wherein the pad holder is made of an elastomeric material of a hardness in the range 50 to 70 on the Durometer D scale.

9. An assembly as claimed in claim 1, wherein the said pad is made of an elastomeric material of a hardness in one of the following ranges measured on the Durometer A scale: 60–75; 75–85; 85–95.

10. For use in co-operation with a male die for press forming relatively small articles of sheet material, the combinations of:

a pad holder of a relatively hard elastomeric material, the holder defining a recess extending longitudinally of the holder and end walls closing the ends of said recess, the recess being of a cross-sectional shape to define opposed downwardly convergent wall portions and conforming generally to the shape into which articles are to be formed; and a plurality of die pads of respectively different hardnesses for use selectively in association with the pad holder, each pad being made of an elastomeric material softer than the said relatively hard elastomeric material of the holder and being adapted to be snugly received in said recess in the holder between the end walls thereof, each pad further having an upper surface to support an article to be formed, and a lower surface, at least parts of which, when the pad is in use in the holder, are in surface contact with said convergent wall portions of said recess in the holder;

whereby, in use, one of said pads is placed in said recess in the holder and an article to be formed is placed on the upper surface of the pad and is engaged by the male die, movement of the die against the article causing the pad to be compressed between the leading extremity of the die and the wall of the recess in the holder to cause the article to bend about the die, the said elastomeric material of the holder being capable of resilient deformation in the event that the die contacts the holder.

11. For use in co-operation with a male die and a die pad of an elastomeric material, a pad holder of a relatively hard elastomeric material, the holder defining a longitudinal recess of relatively short axial length and end walls closing the ends of said recess, the recess being of a cross-sectional shape to define opposed downwardly convergent wall portions and conforming generally to the shape into which articles are to be formed by said die.

* * * * *